United States Patent [19]

Kritzberg

[11] 3,940,863

[45] Mar. 2, 1976

[54] PSYCHOLOGICAL TESTING AND THERAPEUTIC GAME DEVICE

[75] Inventor: Nathan I. Kritzberg, Tenafly, N.J.

[73] Assignee: Psychotherapeutic Devices, Inc., New York, N.Y.

[22] Filed: Dec. 14, 1973

[21] Appl. No.: 424,682

Related U.S. Application Data

[63] Continuation-in-part of Ser. No. 167,372, July 30, 1971, Pat. No. 3,779,557.

[52] U.S. Cl. .... 35/22 R; 273/135 AA; 273/135 AC

[51] Int. Cl.[2] ..... A63F 3/00

[58] Field of Search..... 273/135; 35/22 R, 22 A

[56] References Cited

UNITED STATES PATENTS

| | | | |
|---|---|---|---|
| 2,026,082 | 12/1935 | Darrow | 273/134 |
| 2,506,184 | 5/1950 | Twining | 273/135 F |
| 2,959,871 | 11/1960 | Honkavaara | 35/22 R |
| 3,055,662 | 9/1962 | Kemp | 273/85 |
| 3,722,885 | 3/1973 | Leaf | 273/135 AA |

FOREIGN PATENTS OR APPLICATIONS

| | | | |
|---|---|---|---|
| 368,092 | 3/1932 | United Kingdom | 35/22 R |

*Primary Examiner*—Anton O. Oechsle
*Assistant Examiner*—Joseph R. Taylor
*Attorney, Agent, or Firm*—Ryder, McAulay, Fields, Fisher & Goldstein

[57] ABSTRACT

A game fostering the telling of a story based on iconographic stimuli. A set of objects and figurines are set up on a stimulus board. Each of these objects functions as an icon tending to invoke a significant primary emotion. Dice having different indicia on the faces thereof are thrown by the players. If a first indicia comes up, the players select one, two or three icons about which a story is told. The number of icons selected is a function of a numerical indicia on the die face. If a second indicia comes up, a card is selected which refers to an emotional category and calls for the player to tell a story about an icon on the board that fits the emotional category. Intermediate awards are given for each storytelling. Intermediate rewards during the game and more concrete rewards at the end of the game enhance the game feature and provide an incentive for storytelling and fantasizing.

9 Claims, 3 Drawing Figures

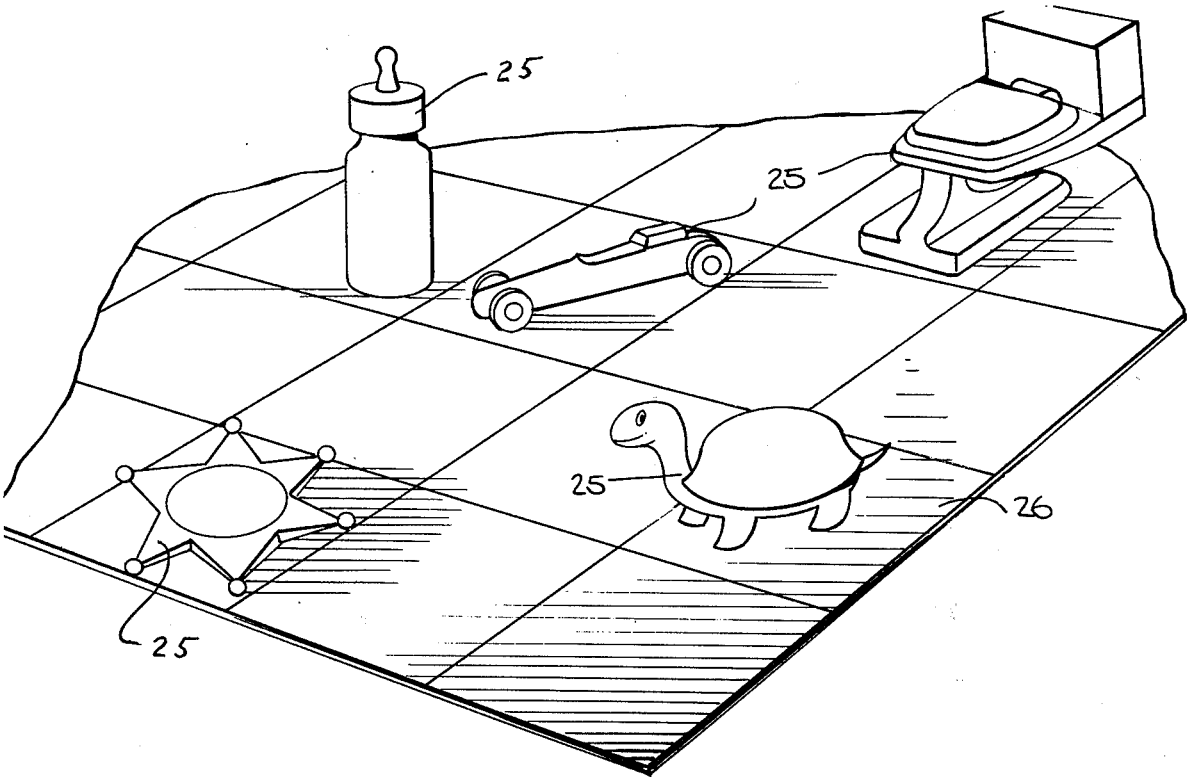
Fig. 1.
Fig. 2.
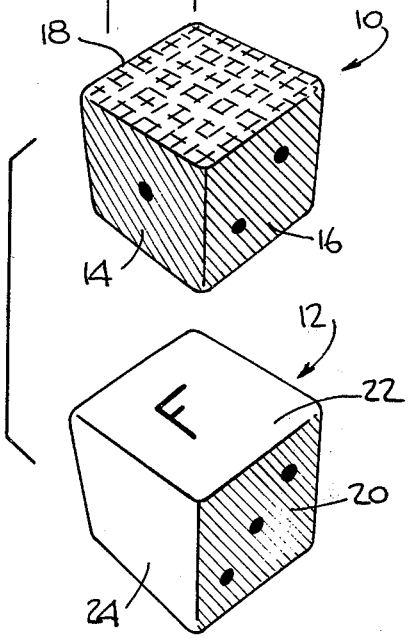
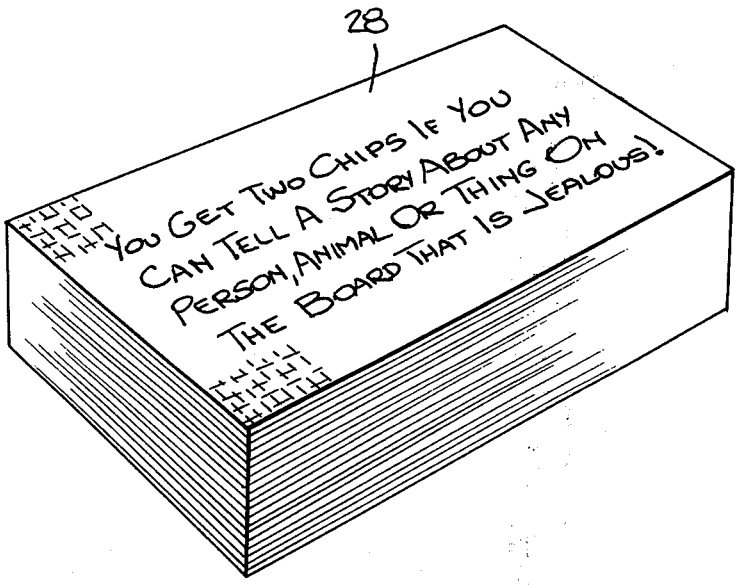
Fig. 3.

PSYCHOLOGICAL TESTING AND THERAPEUTIC GAME DEVICE

REFERENCE TO RELATED APPLICATIONS

This application is a continuation-in-part of copending application Ser. No. 167,372, now U.S. Pat. No. 3,779,557, filed on July 30, 1971, entitled Psychological Testing and Therapeutic Game Device.

BACKGROUND OF THE INVENTION

This invention in general relates to psychological therapy, and more particularly to a game type of device particularly adapted to be employed with children in evoking meaningful and effective storytelling.

In the process of psychological therapy, and in particular with children, it is known to employ a free play situation in order to evoke fantasy which may be a partial basis for analysis and therapy. The fantasizing that results from known techniques tends to be narrow in range and difficult to use in therapy. The major purpose of this invention is to provide a more fruitful fantasy evocation.

It is a further purpose of this invention to provide a context, within which the fantasy evocation occurs, that is amenable to further processing by the therapist. In particular, it is a purpose of this invention to permit the therapist to make inquiry, concerning the fantasy evoked, in a fashion that has a minimum likelihood of freezing the fantasy evocation. It is desired that the therapist inquiry be viewed as part of the fantasy evocation process rather than as a third degree.

It is a further purpose of this invention to provide a specific repeatable, though broad, context within which the fantasy evocation arises so that patterns of fantasy evocation can be observed and some relationship can be drawn to model responses.

It is another purpose of this invention to provide a technique to achieve relevant fantasy evocation in a manner that is an efficient use of the therapist's time.

It is a further more detailed purpose of this invention to provide a less word oriented and more object or icon oriented means to evoke fantasy than is described in the parent patent application.

BRIEF DESCRIPTION OF THE INVENTION

In brief, this invention is in a game, played by patient and therapist, that includes the telling of a story based on object stimuli. A stimulus board is employed that is divided into square spaces and has a number of objects arranged thereon, one object on each square. The objects are selected for their emotional significance and for the fact that they are likely to incite relevant emotional feelings.

The objects are small objects or figurines which are grouped into a number of categories such that all of the objects within any one category tend to evoke the same significant primary emotion. As noted herein, there are eleven such primary emotions into which, in one embodiment, one hundred objects are divided.

A set of two dice are employed. The twelve faces of the two dice are divided into three green faces (one on a first die and two on a second die), one yellow face, one white face carrying the letter "F", and seven empty faces. In addition, there is a set of yellow cards. Each card carries a legend and the set of cards includes a subset of cards which makes reference to various objects on the board generally by reciting a category of objects such as "animal" or a type of emotional characterization such as "lazy."

During play, the set of cards is placed in an upside-down position between the players. The players successively throw the two dice. For each green face that appears face-up when the dice are thrown, the player selects an object from the board and receives a two gold star award if he makes up a story about the object selected. If the yellow face appears on the throw, the player selects the top yellow card and performs in accordance with the instructions thereon which normally provides two gold stars if a story is told about an object selected from some specified category of objects on the board. If the white face with the legend F is thrown, the player receives a two gold star award for telling a story about any one of the objects on the board or, alternately, the telling of any story that comes to mind. If neither face thrown is one of the above, that is, if both faces thrown are empty, then the player loses his turn and the game passes to the next player.

Enhanced results and greater depths of analysis can be obtained by awarding additional gold stars by answering questions about the story told. Still further results can be obtained by providing additional gold stars for dramatizing part or all of the story told. At the end of a player session, the player with the most gold stars is awarded a prize and is deemed the winner or the gold stars are turned in at a certain trade-in rate for trinkets.

BRIEF DESCRIPTION OF THE DRAWINGS

Other objects and purposes of this invention will be apparent from the following detailed description and drawings in which:

FIG. 1 is a representation of some of the objects employed in this invention, positioned on a board.

FIG. 2 is a representation of the dice used in connection with this invention.

FIG. 3 is a representation of the set of yellow cards used in connection with the FIG. 2 dice.

DESCRIPTION OF THE PREFERRED EMBODIMENTS

As shown in FIG. 2, there are two dice 10, 12. The first die 10 has two green faces 14, 16 and one yellow face 18. The rest of the faces (not shown) of this die 10 are blank. The second die 12 has one green face 20 and one white face 22 marked with the letter F. The rest of the faces on this die 12 including the face 24 shown and three faces not shown are blank.

The patient and therapist alternate turns throwing the dice 10, 12 and performing in accordance with the faces turned up on each throw. Two faces will, of course, show on each throw and on each throw there is a possibility of a double performance. For each green face that shows on a throw, the player selects one, two or three objects 25 off the board 26. The number of objects selected corresponds to the number of black dots on the green face. This board 26 is conveniently divided into a set of 100 green squares, 10 × 10, so that each of one hundred objects can be placed on a separate square. Only a few of the hundred objects are shown to avoid a confusing representation. The player gets two gold stars if he tells a story about the object selected. If two green faces show on the throw, then the player selects two sets of objects 25 and has the opportunity to receive four gold stars by telling two stories.

If the yellow face shows, the player selects one of the yellow cards 28 and follows the instructions thereon. Most of the yellow cards 28 will simply provide that the player can get two gold stars if he tells a story about one of the objects selected from the board with the constraint that the object must fit within a category specified on the card. To enhance the game aspect of this device, a few of the cards 28 basically provide for an extra turn or for doubling the award for the next story to be told.

If the white or F face appears, the player gets four gold stars if he tells a story of any sort that comes to his mind.

After an object is removed from the board 26 during play, it is kept off the board to prevent wasteful repetition.

The companion invention described in the referenced patent application deals with an analogous approach employing objects which have such emotional significance as to be appropriately termed iconic objects. The instant invention appears to be better adapted for children who do not react to the written word as much as other children may. In any case, the age range for applicability is approximately three to 13. The objects 10 are carefully selected to cover a range of emotional categories or dimensions. The 100 objects 10, in one embodiment, consist of the following 11 clusters:

1. Orality; that is, dependent orientation. This category is represented by 14 icons, namely: a baby-type milk bottle, a cow with its calves, a set of teeth, an alligator, a hippo, a pig with its piglets, a nurse, a kangaroo (with baby kangaroo in pouch), a goose with its goslings, a shark, a bed, an empty wine-type bottle, a bathtub and a refrigerator.

2. Anality; that is, anal retentive or explosive orientation and urethrality. This category is represented by six icons, namely: a skunk, a toilet, a money-bag of gold coins, a small pile of amorphous brown clay (suggestive of feces), a fire engine, and a wrist watch or clock.

3. Phallic-aggressive (Sado-masochistic) orientation. This category is represented by 18 icons, namely: a gun, a knife, a bullet or bomb, an Indian, a cowboy, a robber (thief) with cap and mask, a snake, a tiger, a lion, a gorilla, a dinosaur, an ambulance, a key, a football, a rhinoceros, a pirate, an elephant, and a bear.

4. Authoritarian orientation. This category is represented by 11 icons, namely: a king, a queen, a fireman, a policemen, a doctor in white garb and stethoscope, a witch, a spider, an owl, a circus ring-master, a police whistle, and a police (sheriff's) badge.

5. Super-ego conflict derivatives. This category is represented by three icons, namely: a devil with pitchfork, a convict with stripes, and a judge in robes with gavel.

6. Self-image derivatives, negative or positive. This category is represented by 20 icons, namely: a clown, a strongman (weight lifter type), a rabbit, a fox, a deer, a frog, a giraffe, a parrot, a camel, a sheep, a poodle, a cat, a fish, a horse, a donkey, a monkey, a turtle, a seal, a snail, and a mouse.

7. Concern with death and/or aging. This category is represented by two icons, namely: an old man (bent and with grey beard), and a coffin or sarcophagus.

8. Narcissistic-exhibitionistic-voyeuristic orientation. This category is represented by four icons, namely: eyeglasses, a lipstick, a tiny mirror and binoculars.

9. Concern with reproduction and/or generativity. This category is represented by three icons, namely: a pregnant woman, an engagement ring with stone and a heart symbol.

10. Competitive orientation. This category is represented by three icons, namely: a racing car, a winning or championship cup (trophy cup) and a report card.

11. Representatives of significant objects (persons, animate and inanimate objects, as well as part-objects). This category is represented by 16 icons, namely: a boy, a girl, a naked boy, a naked girl, a baby, a man, a woman, a nondescript Creepy Crawler, a bird (winged), a dog (e.g., Collie or German Shepherd), a car, a truck, an airplane, a telephone, a horseshoe good-luck charm and a motor boat.

There are seven additional icons in cluster 11. These seven icons are black (Negro) human figures, namely: a boy, a girl, a naked boy, a naked girl, a baby, a man and a woman. They may be used to replace the first seven icons in cluster 11.

The set of yellow cards 28 employed in one embodiment are 41 in number. The 41 cards have on the face thereon, respectively, the following 41 legends:

1. SORRY! YOU MUST RETURN FOUR CHIPS TO THE BANK. (OR AS MANY AS YOU HAVE IF YOU HAVE LESS THAN FOUR).
2. GOOD LUCK! BANK MUST PAY YOU FOUR CHIPS!
3. GOOD LUCK! TAKE FOUR CHIPS FROM EACH OF THE OTHER PLAYERS. (OR AS MANY AS THEY HAVE, IF THEY HAVE LESS THAN FOUR).
4. BAD LUCK! GIVE FOUR CHIPS TO THE PLAYER ON YOUR RIGHT. (OR ALL THOSE YOU HAVE, IF YOU HAVE LESS THAN FOUR).
5. GOOD LUCK! TAKE AN EXTRA TURN NOW.
6. BAD LUCK!! YOU LOSE YOUR NEXT TURN.
7. GOOD LUCK!! JACKPOT! YOU GET DOUBLE CHIPS FOR YOUR NEXT STORY AND ITS QUESTIONS AND PLAY!!
8. CONGRATULATIONS! YOU CAN TELL A STORY ABOUT ANY OBJECT ON THE BOARD WHICH YOU CHOOSE AND YOU GET PROPER REWARDS.
9. GOOD LUCK! IF YOU CAN MAKE UP A DIFFERENT STORY ABOUT ANY OF THE OBJECTS ABOUT WHICH YOU HAVE ALREADY TOLD A STORY, YOU GET TWO CHIPS!!
10. THE PERSON TO YOUR RIGHT MUST MAKE UP A STORY ABOUT ANY OF THE OBJECTS YOU HAVE ALREADY CHOSEN, BUT YOU GET HIS TWO REWARD CHIPS!!
11. YOU GET TWO CHIPS IF YOU CAN TELL A STORY ABOUT ANY ANIMAL ON THE BOARD!
12. YOU GET TWO CHIPS IF YOU CAN TELL A STORY ABOUT ANY NON-LIVING THING OR OBJECT ON THE BOARD!!
13. YOU GET TWO CHIPS IF YOU CAN TELL A STORY ABOUT ANY SCARY OBJECT, ANYTHING SCARY ON THE BOARD!!
14. YOU GET TWO CHIPS IF YOU CAN TELL A STORY ABOUT ANYTHING BAD, ANY BAD OBJECT ON THE BOARD!!
15. YOU GET TWO CHIPS IF YOU CAN TELL A STORY ABOUT ANYTHING HAPPY, ANY HAPPY OBJECT ON THE BOARD!!

16. YOU GET TWO CHIPS IF YOU CAN TELL A STORY ABOUT ANYTHING GOOD, ANY GOOD OBJECT ON THE BOARD!!
17. YOU GET TWO CHIPS IF YOU CAN TELL A STORY ABOUT ANYTHING SAD, ANY SAD OBJECT ON THE BOARD!!
18. YOU GET TWO CHIPS IF YOU CAN TELL A STORY ABOUT ANYTHING ANGRY, ANY ANGRY THING ON THE BOARD!!
19. YOU GET TWO CHIPS IF YOU CAN TELL A STORY ABOUT ANYTHING WEAK, ANY WEAK OBJECT ON THE BOARD!!
20. YOU GET TWO CHIPS IF YOU CAN TELL A STORY ABOUT ANYTHING STRONG, ANY STRONG OBJECT ON THE BOARD!!
21. YOU GET TWO CHIPS IF YOU CAN TELL A STORY ABOUT ANYTHING DIRTY, ANY DIRTY OBJECT ON THE BOARD!!
22. YOU GET TWO CHIPS IF YOU CAN TELL A STORY ABOUT ANYTHING CLEAN, ANY CLEAN OBJECT ON THE BOARD!!
23. YOU GET TWO CHIPS IF YOU CAN TELL A STORY ABOUT ANYTHING SMART, ANY SMART OBJECT ON THE BOARD!!
24. YOU GET TWO CHIPS IF YOU CAN TELL A STORY ABOUT ANYTHING DUMB OR STUPID, ANY DUMB OR STUPID OBJECT ON THE BOARD!!
25. YOU GET TWO CHIPS IF YOU CAN TELL A STORY ABOUT ANYTHING LAZY, ANY LAZY OBJECT ON THE BOARD!!
26. YOU GET TWO CHIPS IF YOU CAN TELL A STORY ABOUT ANYTHING LIVELY OR ACTIVE, ANY OBJECT LIVELY OR ACTIVE, ONE WITH LOTS OF LIFE AND ENERGY, ON THE BOARD!!
27. YOU GET TWO CHIPS IF YOU CAN TELL A STORY ABOUT ANYTHING GREEDY, ANY GREEDY OBJECT ON THE BOARD!!
28. YOU GET TWO CHIPS IF YOU CAN TELL A STORY ABOUT ANYTHING KIND, ANY KIND OBJECT ON THE BOARD!!
29. YOU GET TWO CHIPS IF YOU CAN TELL A STORY ABOUT ANY PERSON, ANIMAL OR THING ON THE BOARD, WITH PROBLEMS OR TROUBLES.
30. YOU GET TWO CHIPS IF YOU CAN TELL A STORY ABOUT ANY PERSON, ANIMAL OR THING ON THE BOARD THAT FEELS GUILTY!!
31. YOU GET TWO CHIPS IF YOU CAN TELL A STORY ABOUT ANY PERSON, ANIMAL OR THING ON THE BOARD WHO IS CRYING.
32. YOU GET TWO CHIPS IF YOU CAN TELL A STORY ABOUT ANY PERSON, ANIMAL OR THING ON THE BOARD WHO GETS RESCUED OR SAVED!
33. YOU GET TWO CHIPS IF YOU CAN TELL A STORY ABOUT ANY PERSON, ANIMAL OR THING ON THE BOARD WHO IS BEING PUNISHED.
34. YOU GET TWO CHIPS IF YOU CAN TELL A STORY ABOUT PERSON, ANIMAL OR THING ON THE BOARD WHO DID SOMETHING WRONG!
35. YOU GET TWO CHIPS IF YOU CAN TELL A STORY ABOUT ANY PERSON, ANIMAL OR THING ON THE BOARD THAT FEELS ASHAMED!!
36. YOU GET TWO CHIPS IF YOU CAN TELL A STORY ABOUT ANY PERSON, ANIMAL OR THING ON THE BOARD WHO IS HIDING!
37. YOU GET TWO CHIPS IF YOU CAN TELL A STORY ABOUT ANY PERSON, ANIMAL OR THING ON THE BOARD THAT HAS A SECRET!!
38. YOU GET TWO CHIPS IF YOU CAN TELL A STORY ABOUT ANY PERSON, ANIMAL OR THING ON THE BOARD THAT IS JEALOUS!!
39. YOU GET TWO CHIPS IF YOU CAN TELL A STORY ABOUT ANY PERSON, ANIMAL OR THING ON THE BOARD THAT IS PROUD!
40. YOU GET TWO CHIPS IF YOU CAN TELL A STORY ABOUT ANY PERSON, ANIMAL OR THING ON THE BOARD THAT IS LONELY!
41. YOU GET TWO CHIPS IF YOU CAN TELL A STORY ABOUT ANY PERSON, ANIMAL OR THING ON THE BOARD THAT WANTS TO HARM SOMEONE!

The value of mixing the objects 10 with the yellow cards 28 in this invention is that it creates a variety of constraints on the patient in selecting objects for storytelling. From the point of view of the 11 psychological categories set forth above, the yellow face 18 on the die 10 by referring to the yellow cards 28 provides a greater degree of constraint than do the green faces 14, 16 which have reference to any object 10 on the board. In general, a throw that turns up the yellow face 18, which calls for the selection of a yellow card, restricts, through that yellow card, the player to a word within one of the eleven psychological categories. By contrast, each green face 14, 16 permits a wide range of selection on the board.

The white face 22, providing a free story option, is of further value in providing an open-ended storytelling situation not limited to anything on the board.

After the story has been completed there are various possibilities open for further therapeutically processing the material. The game sequence up to this point lends itself to various optional therapeutic maneuvers that are initially expressed to the patient as the rules of the game. Experience, judgment and preference will dictate which game plan will be followed.

One useful sequence, after the story has been completed, is to indicate that a further gold star can be obtained by answering a series of questions about the story. The particular questions asked by the therapist will, of course, be analytically oriented questions. These questions may be ostensibly be directed to clarify the story but will in addition, provide insight for at least the therapist and perhaps, also for the patient.

A further rule of the game that is possible is to provide another gold star for the player's dramatization of the story. This dramatization can be effected with the aid of the other child players when the game is used in a group therapy situation.

Thus, as described above, it is possible to acquire four gold stars for elaborating a story around a selected word, replying to questions about the story, and finally, play-acting a scene or scenes around the incidents in the story. The last two features of the game might be modified or eliminated depending upon the wishes of the therapist.

The advantage of having the green die faces 14, 16, 20, the yellow die face 18, the free story die face 22 and the blank faces is that they tend to enhance the game aspect of this invention by providing variation and by providing it in a randomly selected fashion. When a player throws the dice 10, 12 there are four main separate results possible and, in addition, the possibility of a combination result such as one green face and one yellow face. This complicates the nature of the chance the player is taking. To put it another way, this provides a hierarchy of luck in each turn, certain results of each throw being luckier than others in terms of the goals (awards) of the game. Just as there is more excitement in a horse race having a number of horses running, so too there is more excitement and more of a game feeling in having a number of different possibilities for each throw of the dice 10, 12.

The free story face 22 is of further value in providing an open-ended storytelling situation. This open-ended mode of play can serve to quickly and more efficiently bring out matters of greatest concern to the patient player. It provides for the bringing out of matters with the least degree of constraint on the patient. By contrast, the yellow face, and to some extent the green faces, provide a greater degree of constraint. From the point of view of the eleven psychological categories set forth above, the yellow face 18 provides a greater degree of constraint than do the green faces 14, 16, 20 in that the yellow face turns up a card which restricts a player to selection of an icon within one or two of the eleven psychological categories whereas the green face permits icon selection from anyone of the eleven psychological categories. Thus, during the course of play a varying degree of freedom of choice or a varying degree of constraint on the player is provided. This combination of constraint and choice is of value in assuring that a range of emotional ground is covered while at the same time permitting the patient to focus on the emotional matters of greatest concern to him. It is further useful that this combination of constraint and freedom also appears to the patient-player as part of the game aspect of the device.

The player who accumulates the most gold stars during the playing session, usually something under an hour, may be adjudged the winner and given a prearranged award, such as a small toy or trinket. Alternately as incentive award system may be established in which a given number of gold stars are exchanged for a trinket or small toy.

The use of specific concrete rewards, in the form of trinkets given to the child, has certain desirable results. First, the reward is sought by the child and increases the likelihood of the child's entering into the spirit of the game and thus, in effect, being cooperative with the process involved. Perhaps more importantly, the rewards underscore the game-like quality of the process. For the child to view the process as a game is an appreciable factor in gaining the child's active and meaningful participation in the process. In addition, the use of intermediate awards (the gold stars) as part of the inquiry process aids in establishing the inquiry process as part of the overall game process. This fosters acceptance of the inquiry and aids in minimizing the kind of uncooperative reaction that is likely to occur if the child see the inquiry process as a third degree type inquiry.

It should be noted that the device of this invention is indeed a game device and will be seen as such by the patient. The combination of skill and chance features involved assure that it will be seen as a game device.

The particular die face operative at each turn of the game is provided on a chance or random basis. Furthermore, the particular yellow card selected when a yellow face is operative is also picked on a chance or random basis. There is, in addition, an element of skill or volition, as contrasted with chance, in those turns where a story is to be told in that the player selects an icon and further must construct a story about that icon in order to obtain a gold star award.

The game aspect can be further enhanced by the fact that certain of the cards 28 need not call for storytelling. Accordingly for this reason and because of the blank die faces, the storytelling itself and the opportunity for intermediate rewards for storytelling is barred during some of the turns.

By a combination of randomly invoking the various means (the means being the cards and the operative dice faces) by which storytelling is arrived at, by providing different degrees of constraint as to player selection of the icon on which storytelling is to focus and even by barring storytelling during certain turns the result is a device that is readily perceived as a game and not as a forced inquiry. Both skill and chance enter into the game and into the obtaining of rewards. The primary element of skill is in the ability to tell a story. This combination of skill and chance in varying degrees serves to enhance the gamelike aspect of this invention.

It is preferred that the three green faces 14, 16, 20 be differentiated by having, respectively, one, two and three black dots thereon. These dots are used as indicia to indicate that the player is to select, respectively, one, two and three icons 25 from the board 26 for the purpose of telling a story about the icons selected.

Among the advantages of providing this added complexity is that it enhances the game-like quality of the play in part because of the complexity and in part because of the variety provided. More substantively, this procedure compels the player to scan the board more carefully. It also requires the player to integrate two or three objects on the board and provides further insights into relationships as the constellation with which a single icon is placed varies from game to game. This latter variety in constellation will not occur within a single game since, as indicated above, icons used in a single game are withdrawn from the board.

The use of icons instead of words in this invention provides a different dimension to the way in which a primary emotion is presented to the patient. Accordingly, the words used on the set of cards 28 are not the names of the icons 25 on the board 26 so as to minimize the constraint in fantasizing about the object and to enhance relating to the objects as an icon. Yet the key operative words on the cards 28 do provide a direct reference to a primary emotion in order to constrain player selection of an icon to within a range of primary emotions.

What is claimed is:

1. A psychological testing and therapeutic game device adapted to be employed to invoke fantasizing for purposes that include psychological testing and therapy comprising:

a stimulus board, a set of icons arranged on said board, the predominent portion of the icons on said board each evoking a significant primary emotion, said icons comprising a plurality of sub-sets of icons, each of the icons in any one of said sub-sets evoking the same primary emotion, each sub-set evoking a different primary emotion, a set of cards, each having first indicia thereon and each card of said set bearing second indicia referring to one of said primary emotions and requesting the selection of one of said icons corresponding thereto, a pair of dice having a plurality of faces, a first portion, less than the whole, of said faces each having an indicia thereon identical to said first indicia on said set of cards.

2. The device of claim 1 wherein said icons comprise:

a first sub-set of icons evoking orality feelings, a second sub-set of icons evoking anality feelings, a third sub-set of icons evoking phallic-aggressive feelings, a fourth sub-set of icons evoking authoritarian feelings, a fifth sub-set of icons evoking super-ego conflict feelings, a sixth sub-set of icons evoking self-image feelings, a seventh sub-set of icons evoking feelings about aging and death, an eighth sub-set of icons evoking narcissistic-exhibitionistic feelings, a ninth sub-set of icons evoking feelings concerning reproduction, and a tenth sub-set of icons evoking competitive feelings.

3. The device of claim 1 further comprising:

an eleventh sub-set of icons relating to significant objects to which other significant primary emotions attach.

4. The device of claim 1 wherein:

said board has a plurality of squares, a portion, less than the whole, of said squares having a second indicia thereon, said pair of dice have a second portion, less than the whole, of said faces each having a second indicia theron identical to said second indicia on said squares of said board, one of said icons being positionable on each of said squares.

5. The device of claim 2 wherein:

said board has a plurality of squares, a portion, less than the whole, of said squares having a second indicia thereon, said pair of dice have a second portion, less than the whole, of said faces each having a second indicia thereon identical to said second indicia on said squares of said board, one of said icons being positionable on each of said squares.

6. The device of claim 5 further comprising:

an eleventh sub-set of icons relating to significant objects to which significant emotions attach.

7. The device of claim 4 wherein:

said second portion of said faces each have a separate numerical indicia thereon.

8. The device of claim 5 wherein:

said second portion of said faces each have a separate numerical indicia thereon.

9. The device of claim 6 wherein:

said second portion of said faces each have a separate numerical indicia thereon.

* * * * *